US006547573B1

(12) United States Patent
Allen et al.

(10) Patent No.: US 6,547,573 B1
(45) Date of Patent: Apr. 15, 2003

(54) METHOD AND APPARATUS FOR PRODUCING A GROUNDING PATH ON A STRUCTURE

(75) Inventors: James G. Allen, Tacoma, WA (US); Frederick L. Knoll, Kent, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/335,014

(22) Filed: Jun. 17, 1999

(51) Int. Cl.[7] ..... H01R 4/66
(52) U.S. Cl. ..... 439/92
(58) Field of Search ..... 439/92, 100, 564, 439/95, 96, 742; 411/103, 105, 107, 113

(56) References Cited

U.S. PATENT DOCUMENTS

| | | | | | |
|---|---|---|---|---|---|
| 2,400,270 | A | * | 5/1946 | Tinnerman | 411/103 |
| 2,401,824 | A | | 6/1946 | Gladden et al. | |
| 2,477,429 | A | * | 7/1949 | Swansstrom et al. | 411/111 |
| 2,650,286 | A | * | 8/1953 | Ramos | 200/246 |
| 2,745,458 | A | | 5/1956 | Bedford, Jr. | |
| 2,948,316 | A | * | 8/1960 | Sing et al. | 411/103 |
| 3,753,213 | A | * | 8/1973 | Frey | 439/410 |
| 3,861,774 | A | * | 1/1975 | Willis | 339/14 R |
| 3,922,050 | A | | 11/1975 | Lettini et al. | |
| 4,270,591 | A | * | 6/1981 | Gill et al. | 411/112 |
| 4,348,140 | A | * | 9/1982 | Bergholz et al. | 411/103 |
| 4,911,591 | A | * | 3/1990 | Oaks | 411/177 |
| 4,963,063 | A | | 10/1990 | Gulistan | |
| 5,020,952 | A | | 6/1991 | Ziegler et al. | |
| 5,059,074 | A | | 10/1991 | Guevarra et al. | |
| 5,066,180 | A | | 11/1991 | Lang et al. | |
| 5,094,622 | A | * | 3/1992 | Auclair | 439/92 |
| 5,308,925 | A | * | 5/1994 | Paterek et al. | 174/152 GM |
| 5,407,310 | A | * | 4/1995 | Kassouni | 411/107 |
| 5,499,449 | A | * | 3/1996 | Carter et al. | 29/882 |
| 5,779,409 | A | * | 7/1998 | Manzolli | 411/7 |
| 5,802,680 | A | * | 9/1998 | Postelwait | 24/135 |
| 6,109,849 | A | * | 8/2000 | Nagayama | 411/181 |
| 6,220,803 | B1 | * | 4/2001 | Schellhase | 411/107 |

* cited by examiner

*Primary Examiner*—Lynn D. Feild
*Assistant Examiner*—Thanh-Tam Le
(74) *Attorney, Agent, or Firm*—Black Lowe & Graham

(57) ABSTRACT

A method and apparatus are disclosed for providing an electrical ground path on a structure such as a commercial aircraft. The method includes inserting a stud through a hole in a grounding plate or structure; riveting the head of the stud to the grounding plate or structure; and applying an electrically compatible build-up of washers, threaded nuts, and an electrical connector over the stud to hold the build-up in electrically conductive contact with the grounding plated or structure. In a preferred embodiment, the stud is threaded and the build-up includes a nut to hold the components in electrically conductive contact with the structure. The stud preferably has an enlarged and flattened head or spade portion with a hole for receiving a rivet. The stud acts as a self-retaining, anti-spin, grounding stud-fastener.

9 Claims, 1 Drawing Sheet

METHOD AND APPARATUS FOR PRODUCING A GROUNDING PATH ON A STRUCTURE

BACKGROUND OF THE INVENTION

This invention relates to grounding of electrical systems in structures such as airplanes.

There has been a long-standing problem concerning installation of grounding studs on commercial aircraft. Threaded fastener studs are used on aircraft structure to establish a ground interface for electrical systems wiring to the aircraft's structural ground plane. But, during assembly or maintenance procedures, the fastener-studs can loosen and require retorqueing. Because of the wiring complexity and structural interferences common in aircraft manufacturing, access to the backside of the ground plane structure for restraining a stud's rotation during retorqueing is a difficult task. Also, simple wire terminal removal or replacement procedures can result in the stud-terminal-retaining nut assembly to come loose and spin in place. This can tear off the wiring terminals or result in other damage.

These problems significantly impact commercial aircraft manufacturing costs and schedules.

BRIEF SUMMARY OF THE INVENTION

The invention provides a method and an apparatus for producing a grounding path on a structure, which is particularly advantageous for commercial aircraft manufacturing processes. In a preferred embodiment, a method for providing an electrical ground path on a structure, such as a grounding plate on a commercial aircraft, includes pre-drilling holes in the structure with standard spacing between a grounding stud and a retaining rivet, inserting a stud (with a pre-drilled retaining rivet hole to match standard spacing) through its respective mounting hole in the structure, aligning holes and riveting the leg of the grounding stud to the structure using a oneside installed pop rivet through the pre-drilled holes, installing a washer over the ground stud, installing a jam nut to the wire terminal side of the structure and tightening the jam nut to prescribed torque, installing wire terminals as required, installing a washer over the wire terminals, installing a lock nut, and tightening the lock nut to prescribed torque.

In a preferred embodiment, the stud includes a head or spade portion extending substantially perpendicular to the threaded portion of the stud and adapted for receiving a rivet (for example, a pop rivet). An apparatus according to a preferred embodiment includes a stud having a head which includes a spade disposed substantially perpendicular to the threaded stud with a hole therethrough adapted for receiving a rivet.

In a preferred embodiment, the stud acts as a self-retaining grounding stud-fastener. The head of the stud is enlarged to produce a flat spade head oriented at a right angle to the threaded shank portion of the stud. Holes are pre-drilled in the structure and stud head at a standard spacing to match the distance between the centerline of the stud shank and the retaining rivet to ensure alignment during assembly. The head receives a rivet (preferably from the wire terminal side) to prevent rotation of the ground stud during nut installation, removal, replacement, or retorqueing. The ground stud head is designed with enough edge margin from the pre-drilled rivet hole to allow for hole enlarging to accept a larger rivet if damage is done to either rivet hole and rework is required.

This solves a long-standing problem in aircraft manufacture, where small enclosed spaces and complex wiring paths and structures make it difficult to access both sides of a grounding plate that incorporates grounding studs that can spin. Once installed, a preferred embodiment of this invention will allow installation, servicing, and replacement of wiring from one side of the grounding plate.

DETAILED DESCRIPTION OF THE INVENTION

Figure 1:
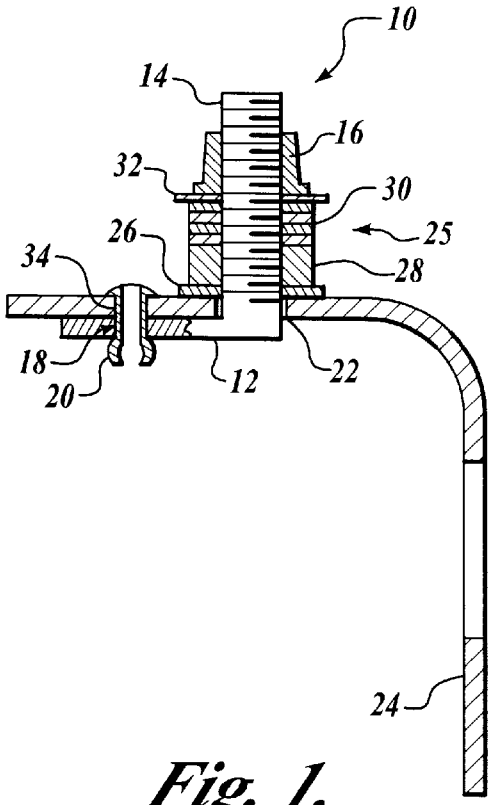
FIG. 1 is a partially cut away side view illustrating a preferred embodiment of the invention.
Figure 2:
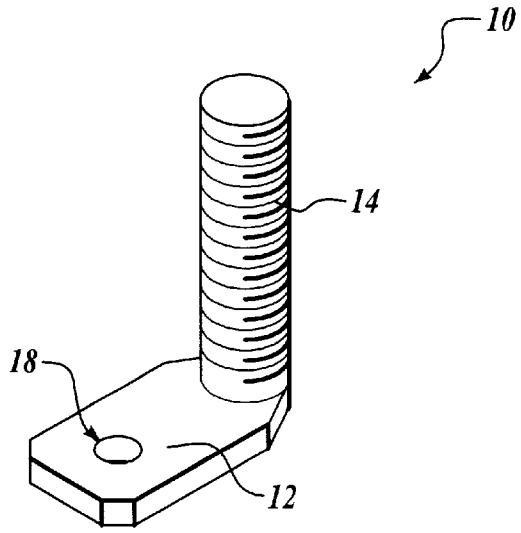
FIG. 2 is a perspective view of a stud used in a preferred embodiment of the invention.

With reference to FIGS. 1 and 2, a grounding stud 10 is provided with a head 12 and a threaded shank 14. The shank 14 is threaded so as to accept a commercially available threaded nut 16. The grounding stud 10 has a head 12 formed as a substantially flattened and enlarged portion or spade disposed substantially perpendicular to the threaded shank 14. The head 12 has a rivet hole 18 formed therein to accept a rivet 20.

To provide a grounding path for an electrical connection, the grounding stud 10 is inserted through a hole 22 in a bracket or structure which has preferably planar surface, such as the grounding plate 24 shown in FIG. 1. In an aircraft, this grounding plate 24 would be attached to an aircraft structure.

The head 12 of the grounding stud 10 is then riveted to the grounding plate 24. In some cases, holes would be drilled, the grounding stud 10 would be inserted, and the head 12 of the grounding stud 10 would then be riveted into a load-carrying structure of the aircraft.

At this point the grounding stud 10 has been installed into a grounding plate 24 or aircraft structure and is ready to accept a ground path wire connection build-up 25. The build-up 25 is constructed as follows. A washer 26 of electrically compatible material is placed over the threaded shank 14 of the ground stud 10. A jam nut 28 of electrically compatible material is then threaded down over the threaded section of the grounding stud 14 and tightened to the appropriate torque. Single or multiple wire terminals 30 are then placed over the threaded shank 14 of the grounding stud 10. A washer 32 is placed over the threaded shank 14 of the grounding stud 10 on top of the wire terminals 30 to minimize a tendency of the wire terminals 30 to turn when the lock nut 16 is installed or removed. The lock nut 16 is then threaded down over the threaded shank 14 and tightened to the appropriate torque to hold the build-up 25 tightly in place. The build-up 25 creates a grounding path from the wire terminals 30 through the jam nut 28 and the washer 26 to the grounding plate 24 or aircraft structure.

In a preferred embodiment the rivet hole 18 and a rivet hole 34 are pre-drilled in the grounding stud 10 and the grounding plate 24 or structure, respectively, at a predetermined spacing to match up during assembly rather than drilling the rivet holes 18 and 34 during assembly.

In a preferred embodiment the rivet hole 18 spacing or dimension from the centerline of the threaded shank 14 of the grounding stud 10 is specifically matched to a spacing available with a special purpose nutplate drill, such as a Winslow drill. Alternately, the spacing can be achieved with a nutplate jig, and the holes can be drilled with any acceptable, known hand-held drill. The nutplate drill locates the drill position at a given standoff from an existing hole to ensure relative accuracy. The drill mechanically indexes into the hole 22 by using an expanding collet to grip the hole 22 and secure the nutplate drill motor while drilling the rivet hole 34. An example of a preferred embodiment for this application includes pre-drilling the hole 22 that will eventually accept the threaded shank 14 of the grounding stud 10. Then, a nutplate-type drill is used to drill the rivet hole 34 by indexing off the existing hole 22. The design of hole spacing to match existing special purpose equipment, such as a Winslow drill or a hand-held drill used in conjunction with a nutplate jig, is intended to speed up production and ensure the accuracy needed to eliminate assembly problems. It eliminates the need for measuring or laying out the hole spacing.

In a preferred embodiment, the rivet hole 18 is spaced to provide adequate spacing between the rivet 20, the washer 26, and the jam nut 28 for a wrench or socket to tighten the jam nut 28 without interference. Such adequate spacing is provided even when a next larger-sized rivet is installed, such as when the rivet holes 18 and 34 are subject to rework.

Although the invention has been described above with respect to a certain specific embodiment, the scope of the invention is not limited to the specific embodiment disclosed. Other designs within the spirit and scope of the invention will be apparent to those skilled in the field after receiving the above teachings. The scope of the invention, therefore, is defined by reference to the following claims.

What is claimed is:

1. A method for providing an electrical ground path on a structure, the method comprising:

inserting through a hole in the structure a stud having a head at one end and a threaded shank wherein the head of the stud includes a spade that extends in one piece substantially perpendicularly from the threaded shank and is adapted for receiving a rivet therethrough, the spade having a substantially planar surface that is arranged to conform to the structure such that the head of the stud is arranged to be riveted to the structure;

riveting the head of the stud to the structure;

placing an electrical connector over the shank; and applying a fastener to the shank so as to hold the electrical connector in electrically conductive contact against the structure.

2. The method of claim 1 wherein the shank is threaded, and applying the fastener to the shank includes threading a jam nut onto the shank.

3. The method of claim 2 wherein the head portion has formed therethrough a hole for receiving the rivet.

4. The method of claim 3, wherein the hole in the head portion is laterally spaced a first distance from centerline of the threaded shank, and wherein riveting the head of the stud to the structure further comprises drilling a hole in the structure for receiving the rivet therethrough, the hole in the structure being laterally spaced the first distance from centerline of the hole in the structure through which the threaded shank is inserted.

5. The method of claim 4, wherein the hole in the structure for receiving the rivet therethrough is drilled with a nutplate drill.

6. The method of claim 4, wherein the first distance from the centerline of the hole in the structure through which the threaded shank is inserted is determined with a nutplate jig, and the hole in the structure for receiving the rivet therethrough is drilled with a hand-held drill.

7. A method for providing an electrical ground path on an aircraft structure, the method comprising:

providing a grounding plate having a hole therethrough;

inserting through the hole in the grounding plate a stud having a threaded shank and a head wherein the head of the stud includes a spade that extends in one piece substantially perpendicularly from the threaded shank and is adapted for receiving a rivet therethrough, the spade having a substantially planar surface that is arranged to conform to the structure such that the head of the stud is arranged to be riveted to the structure;

riveting the head of the stud to the plate; and threading a nut on the shank of the stud.

8. A method for providing an electrical ground path on a grounding plate, the grounding plate having a hole therethrough, the method comprising:

inserting through the hole in the grounding plate a stud having a head and a threaded shank wherein the head of the stud includes a spade that extends in one piece substantially perpendicularly from the threaded shank and is adapted for receiving a rivet therethrough, the spade having a substantially planar surface that is arranged to conform to the grounding plate such that the head of the stud is arranged to be riveted to the grounding plate;

riveting the head of the stud to the grounding plate with a rivet;

placing a first electrically compatible washer over the threaded shank of the stud so the washer is in electrical contact with the grounding plate;

threading an electrically compatible jam nut over the threaded shank of the stud;

torqueing the jam nut to make electrical contact with the washer;

placing a wire terminal over the threaded shank of the stud so the wire terminal is in electrical contact with the jam nut;

placing a second washer over the threaded shank of the stud so the second washer contacts the wire terminal;

threading a lock nut over the threaded shank of the stud so the lock nut contacts the second washer; and torqueing the lock nut such that the wire terminal is held in electrical contact with the grounding plate.

9. The method of claim 8 wherein the rivet is a pop rivet.

* * * * *